US006672994B1

(12) United States Patent
Stearns et al.

(10) Patent No.: US 6,672,994 B1
(45) Date of Patent: Jan. 6, 2004

(54) TOTAL BODY EXERCISE METHODS AND APPARATUS

(76) Inventors: Kenneth W. Stearns, P.O. Box 55912, Houston, TX (US) 77055; Joseph D. Maresh, P.O. Box 645, West Linn, OR (US) 97068-0645

( * ) Notice: Subject to any disclaimer, the term of this patent is extended or adjusted under 35 U.S.C. 154(b) by 276 days.

(21) Appl. No.: 09/684,667

(22) Filed: Oct. 6, 2000

(51) Int. Cl.[7] ..... A63B 69/16
(52) U.S. Cl. ..... 482/57; 482/62; 482/63
(58) Field of Search ..... 482/51, 52, 55–60, 482/63–65, 70, 71, 62

(56) References Cited

U.S. PATENT DOCUMENTS 4,785,674 A * 11/1988 Orman et al. ..... 73/862.17
5,125,648 A * 6/1992 Olschansky et al. ..... 482/62
5,129,872 A * 7/1992 Dalton et al. ..... 482/52
5,181,894 A * 1/1993 Shieng ..... 482/70
5,919,115 A * 7/1999 Horowitz et al. ..... 482/6
6,080,088 A * 6/2000 Petersen et al. ..... 482/72
6,277,055 B1 * 8/2001 Birrell et al. ..... 482/52

* cited by examiner

*Primary Examiner*—Nicholas D. Lucchesi
*Assistant Examiner*—Tam Nguyen

(57) ABSTRACT

An exercise apparatus includes a frame, an arm supporting member, and a leg supporting member. A sensor is connected to the arm supporting member, and/or a resilient member is interconnected between the arm supporting member and either the leg supporting member or the frame. The sensor communicates with a user display and/or a resistance device to indicate the amounts of work performed by the arm supporting member and the leg supporting member, and/or to adjust resistance to movement of the leg supporting member as a function of user force applied against the arm supporting member. The resilient member encourages synchronization of the arm supporting member and the leg supporting member, while allowing some relative movement therebetween.

18 Claims, 8 Drawing Sheets

TOTAL BODY EXERCISE METHODS AND APPARATUS

FIELD OF THE INVENTION

The present invention relates to exercise methods and apparatus and more specifically, to unique arrangements between arm supporting members and leg supporting members on various types of exercise equipment, including elliptical exercise machines.

BACKGROUND OF THE INVENTION

Exercise equipment has been designed to facilitate various exercise motions, many of which incorporate both arm movements and leg movements. Examples of such equipment include elliptical exercise machines (U.S. Pat. Nos. 5,242,343, 5,423,729, 5,540,637, 5,725,457, and 5,792,026); free form exercise machines (U.S. Pat. Nos. 5,290,211 and 5,401,226); rider exercise machines (U.S. Pat. Nos. 2,603,486, 5,695,434, and 5,997,446); glider/strider exercise machines (U.S. Pat. Nos. 4,940,233 and 5,795,268); stepper exercise machines (U.S. Pat. No. 4,934,690); bicycle exercise machines (U.S. Pat. Nos. 4,188,030 and 4,509,742); and various other, miscellaneous exercise machines (U.S. Pat. Nos. 4,869,494 and 5,039,088). These patents are incorporated herein by reference as examples of suitable applications for the present invention.

Generally speaking, the foregoing exercise machines have arm supporting members and leg supporting members which are synchronized to facilitate a coordinated "total body" exercise motion. The synchronized motion is considered advantageous to the extent that it makes the equipment relatively easy to use. On the other hand, the perceived quality of exercise tends to exceed the actual quality of exercise because the arms typically perform very little work. In industry terminology, the arms are generally "along for the ride."

In contrast to the foregoing machines, other exercise machines have been developed to provide independent upper body exercise and lower body exercise. One notable example is the NordicTrack ski machine (U.S. Pat. No. 4,728,102). On machines of this type, both the perceived quality of exercise and the actual quality of exercise are relatively greater. The trade-off is that many people consider such machines relatively difficult to use, due to the independent nature of the arm motions and the leg motions. Recognizing that each of the foregoing types of total body exercise machines suffers certain shortcomings, room for improvement remains with respect to total body exercise machines.

SUMMARY OF THE INVENTION

The present invention provides unique methods and apparatus for total body exercise. In one sense, the present invention may be described as encouraging one or more arm supporting members to be synchronized relative to respective leg supporting member(s) while allowing relative movement between the arm supporting members and respective leg supporting members in response to the application of force by a user. The present invention may also be said to encourage one or more arm supporting members to be synchronized relative to respective leg supporting member (s) while subjecting the arm supporting members to resistance which is applied and/or measured independent of the leg supporting members.

A preferred embodiment of the present invention includes a frame, left and right leg supporting members, and left and right arm supporting members. Each leg supporting member is part of a linkage assembly designed to accommodate foot motion through a generally elliptical path, and each arm supporting member is pivotally connected to the frame and/or a respective leg supporting member to accommodate hand motion through a generally reciprocal path. A separate resilient member is interconnected between each arm supporting member and either the frame or a respective leg supporting member to bias the arm supporting member to move through a particular path in response to movement the respective leg supporting member. As a result, each arm supporting member remains synchronized with a respective leg supporting member in the absence of user force applied against the arm supporting member. Alternative embodiments of the present invention may be implemented with different numbers and types of leg supporting members and/or arm supporting members.

The preferred embodiment also includes a resistance device to provide adjustable resistance to movement of the leg supporting members and the arm supporting members, and sensors for detecting user force exerted against respective arm supporting members. In one desired mode of operation, resistance to movement of the leg supporting members is set, and the resistance is subsequently adjusted as a function of user force applied against the arm supporting members. As a result, upper body work can increase or decrease without affecting the amount of lower body work being performed by the user. Alternative embodiments of the present invention may be implemented with this "responsive resistance" arrangement to the exclusion of the resilient members discussed in the preceding paragraph, or with the resilient members to the exclusion of the "responsive resistance" arrangement.

The present invention may also be described in terms of distinguishing between work performed by a user's arms and work performed by a user's legs. For example, a controller may periodically sense the force exerted by a user's arms and display the amount of upper body work being performed, either alone or in comparison to lower body work and/or target levels of work. The same controller may also adjust the leg resistance device based upon the work being performed by the user's arms (as discussed above) and/or the total work being performed, for example.

Certain embodiments of the present invention are described in greater detail below and/or shown in the accompanying figures. However, the present invention is not limited to these particular embodiments, nor even to the types of machines on which they are shown. Moreover, the present invention is applicable to different combinations of force receiving and/or limb moving members, and additional variations and/or advantages will become more apparent from the detailed description that follows.

BRIEF DESCRIPTION OF THE DRAWING

With reference to the Figures of the Drawing, wherein like numerals represent like parts and assemblies throughout the several views.

DETAILED DESCRIPTION OF PREFERRED EMBODIMENTS

Figure 1:
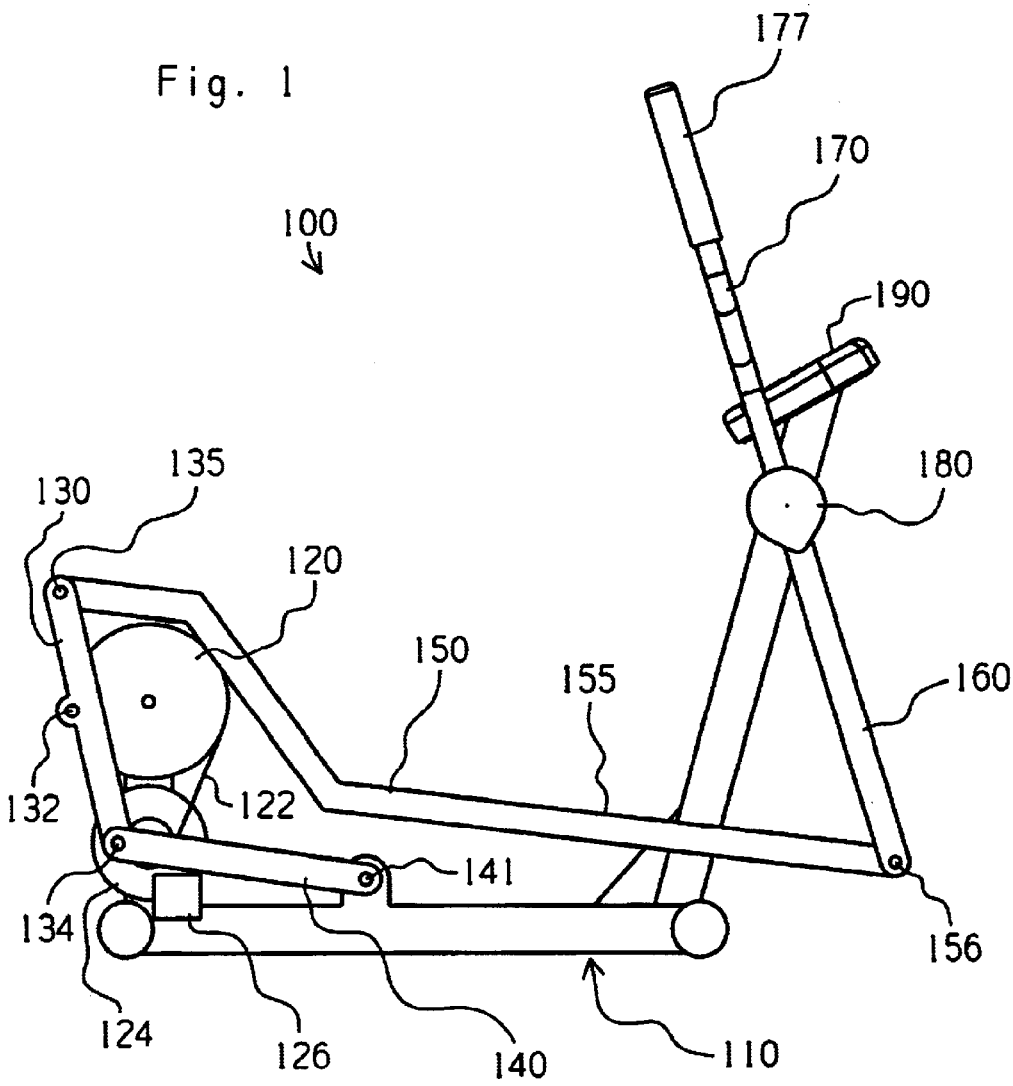
FIG. 1 is a side view of an exercise apparatus constructed according to the principles of the present invention.
Figure 2:
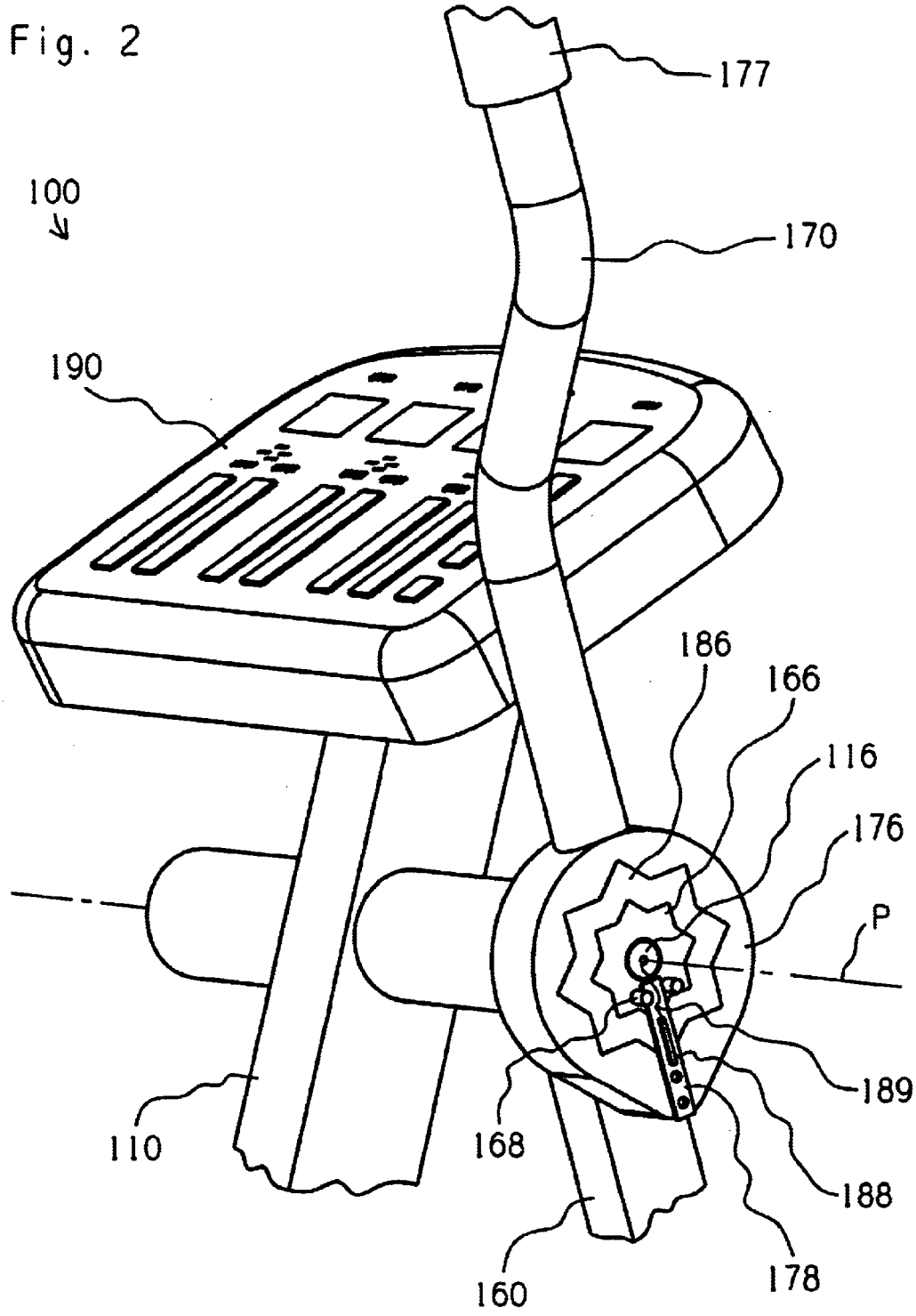
FIG. 2 is an enlarged perspective view of a portion of the exercise apparatus of FIG. 1.
Figure 3:
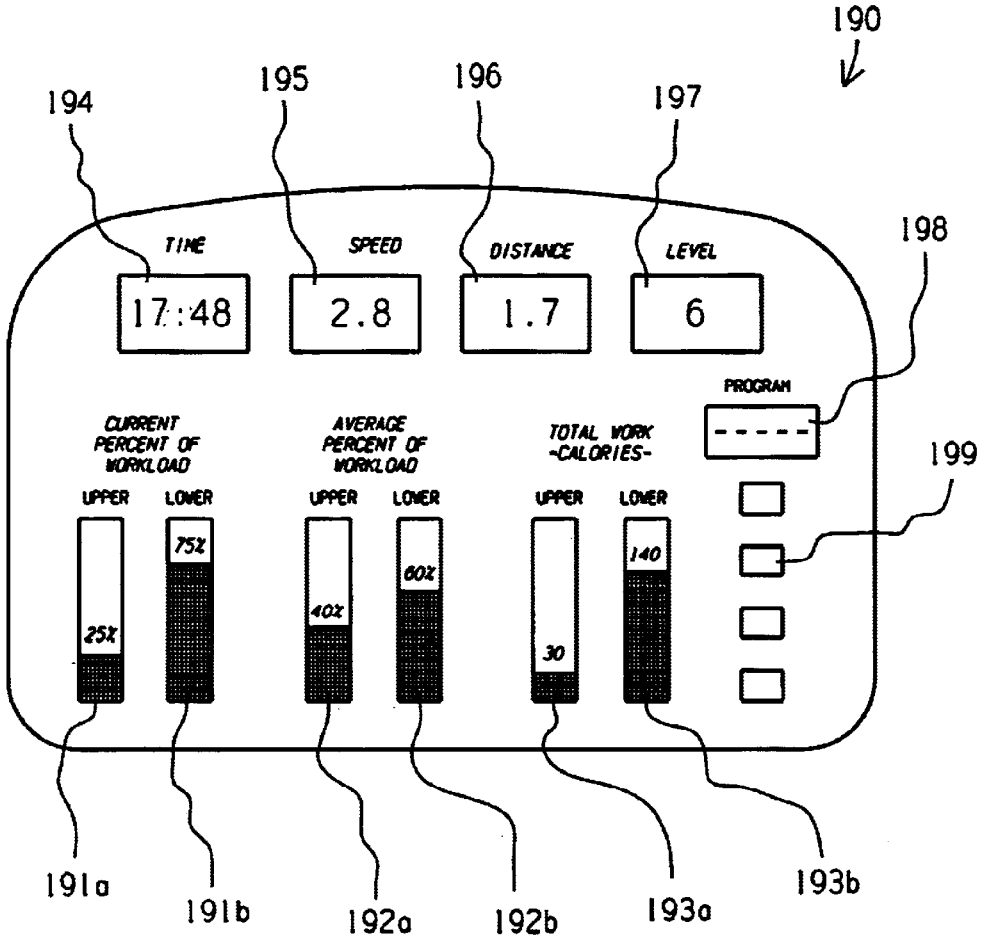
FIG. 3 is a plan view of a user interface on the exercise apparatus of FIG. 1.

An exercise apparatus constructed according to the principles of the present invention is designated as 100 in FIGS. 1–2. The exercise apparatus 100 is an elliptical motion exercise machine that is similar in many respects to certain exercise machines disclosed in U.S. Pat. No. 5,895,339 (which is incorporated herein by reference). However, the present invention is not limited to this specific type of exercise machine nor to any particular category of exercise machines, but rather, is suitable for use on various sorts of exercise equipment having first and second limb exercising members. Examples of some other suitable applications are disclosed in the prior art patents identified above in the Background of the Invention.

The exercise apparatus 100 is generally symmetrical about a vertical plane extending lengthwise through its center. Generally speaking, the apparatus 100 includes similar "right-hand" linkage components and "left-hand" linkage components which are disposed on opposite sides of the plane of symmetry, and which are one hundred and eighty degrees out of phase relative to one another. Like reference numerals are used to designate both the "right-hand" and "left-hand" parts, and when reference is made to one or more parts on only one side of an apparatus, it is to be understood that corresponding part(s) are disposed on the opposite side of the apparatus. Certain components, which are intersected by the plane of symmetry and/or are associated with the inertial characteristics of the linkage assembly, exist individually and thus, do not have any "opposite side" counterparts.

The exercise apparatus 100 includes a frame 110 which extends from a forward end to a rearward end and has a base configured to rest upon a floor surface. A forward stanchion extends upward from the base at the forward end of the frame 110, and a rearward stanchion extends upward from the base at the rearward end of the frame 110. Also, a trunnion extends-upward from the base at an intermediate portion of the frame 110. The linkage assembly is movably interconnected between the rearward stanchion, the forward stanchion, and the intermediate trunnion. Generally speaking, the linkage assembly links rotation of left and right cranks 120 to generally elliptical motion of left and right foot supports 155. The term "generally elliptical motion" is intended in a broad sense to describe a closed path of motion having a relatively longer first axis and a relatively shorter second axis (which extends perpendicular to the first axis).

On each side of the apparatus 100, a respective crank 120 is rotatably mounted on the rear stanchion via a common crank shaft. The depicted crank 120 is a disc which also functions as a pulley (or sprocket), but the invention is not limited to this particular arrangement. A flywheel 124 is rotatably mounted on the rear stanchion, beneath the crank disc 120, and connected in "stepped-up" fashion to the crank disc 120. In particular, a relatively smaller diameter pulley (or sprocket) is rigidly secured to the flywheel 124 and linked to the crank disc 120 by means of a looped member 122, such as a timing belt (or chain). An eddy current resistance device 126 is mounted on the frame 110 and operatively connected to the flywheel 124. The components described in this paragraph, as well as their arrangement and operation, are well known in the art. Generally speaking, the flywheel 124 adds inertia to the linkage assembly, and the eddy current resistance device 126 provides adjustable resistance to rotation of the flywheel 124 (and associated movement of the components of the linkage assembly).

A radially displaced portion of each crank 120 is rotatably connected to an intermediate portion of a respective connector link 130 at a respective connection point 132. The lower end of each connector link 130 is rotatably connected to a rearward end of a respective rocker link 140. An opposite, forward end of each rocker link 140 is pivotally connected to the intermediate trunnion at a respective connection point 141. An opposite, upper end of each connector link 130 is rotatably connected to a rearward end of a respective foot supporting link 150 at a respective connection point 135. An opposite, forward end of each foot supporting link 150 is rotatably connected to a lower end of a respective rocker link 160 at a respective connection point 156. An intermediate portion of each foot supporting link 150 is sized and configured to function as a respective foot support 155. An opposite, upper end of each rocker link 160 is rotatably connected to the forward stanchion at pivot axis P (shown in FIG. 2).

On each side of the apparatus 100, a hub 166 is rigidly secured to the upper end of a respective rocker link 160 and has a star-shaped perimeter which projects axially, in a direction away from the central plane of symmetry. A generally annular member 186 has a central, star-shaped opening which fits snugly about a respective hub 166, thereby keying the two members 186 and 166 to one another. For reasons that become more apparent below, the member 186 is resilient and preferably made of rubber. The resilient member 186 has a star-shaped perimeter which is similar in shape but larger in size than the perimeter of the hub 166. A plate 176 has a central, star-shaped opening which fits snugly about a respective resilient member 186, thereby keying the two members 186 and 176 to one another. A handlebar 170 has a lower end which is rigidly connected to a respective plate 176, and an opposite, upper end 177 which is sized and configured for grasping in a respective hand of a user standing on the foot supports 155.

On each side of the apparatus 100, two pegs 168 are rigidly secured to a respective hub 166, project axially outward from the hub 166, and define a gap therebetween. A metal strip 178 has an upper end which is disposed in the gap between a respective pair of pegs 168, and an opposite, lower end which is rigidly secured to a respective plate 176. A strain gauge 188 (or other suitable sensor) is mounted lengthwise on a respective strip 178 and connected to a respective wire 189 which extends into the frame 110 via a centrally located bore in the pivot shaft. Covers 180, sized and configured to span the exposed side of the plates 176 (and the components within the planform of the plates 176), are preferably secured (bolted, for example) to respective hubs 166 to shroud the components and/or prevent relative axial movement between respective plates 176, annular members 186, and hubs 166.

The strain gauge 188 operates in a manner known in the art to generate an electrical signal which is indicative of strain experienced by the strip 178. An alternative type of suitable sensor may simply measure displacement, for example. Those skilled in the art will also recognize that similar sensor arrangements (and/or flexing arrangements) may be placed on other suitable portions of the apparatus 100 to measure work and/or provide tactile feedback in response to the application of arm force.

Generally speaking, the arrangement inside each cover 180 biases a respective handlebar 170 to remain in a particular orientation relative to a respective rocker link 160. As a result, each handlebar 170 will simply pivot together with a respective rocker link 160 (entirely "in sync") when a user of the apparatus 100 is exercising his lower body to the exclusion of his upper body. However, when the user applies force through either handlebar 170, the respective resilient member 186 will accommodate some pivoting or "flexing" of the handlebar 170 relative to the respective rocker link 160. The freedom to move the handlebar 170 out of sync, although limited in range, tends to provide the user with the sensation of having accomplished something with his upper body independent of the motion associated with exercise of his lower body. In other words, the user can increase the arm exercise stroke relative to the leg exercise stroke, simply by pulling and/or pushing on respective handles 177, preferably in a manner which remains coordinated with movement of the rocker links 160. Generally speaking, the length of the arm exercise stroke is a function of force exerted by the user against the handles 177 (under a given set of operating parameters). On the preferred embodiment 100, the dampening effect of the rubber members 186 tends to limit the rate of change in the length of the arm exercise stroke. Also, if desired, the available range of relative motion may be strictly limited by placing overlapping stops on the handlebars 170 and either the rocker links 160 or the frame 110.

Figure 4A:
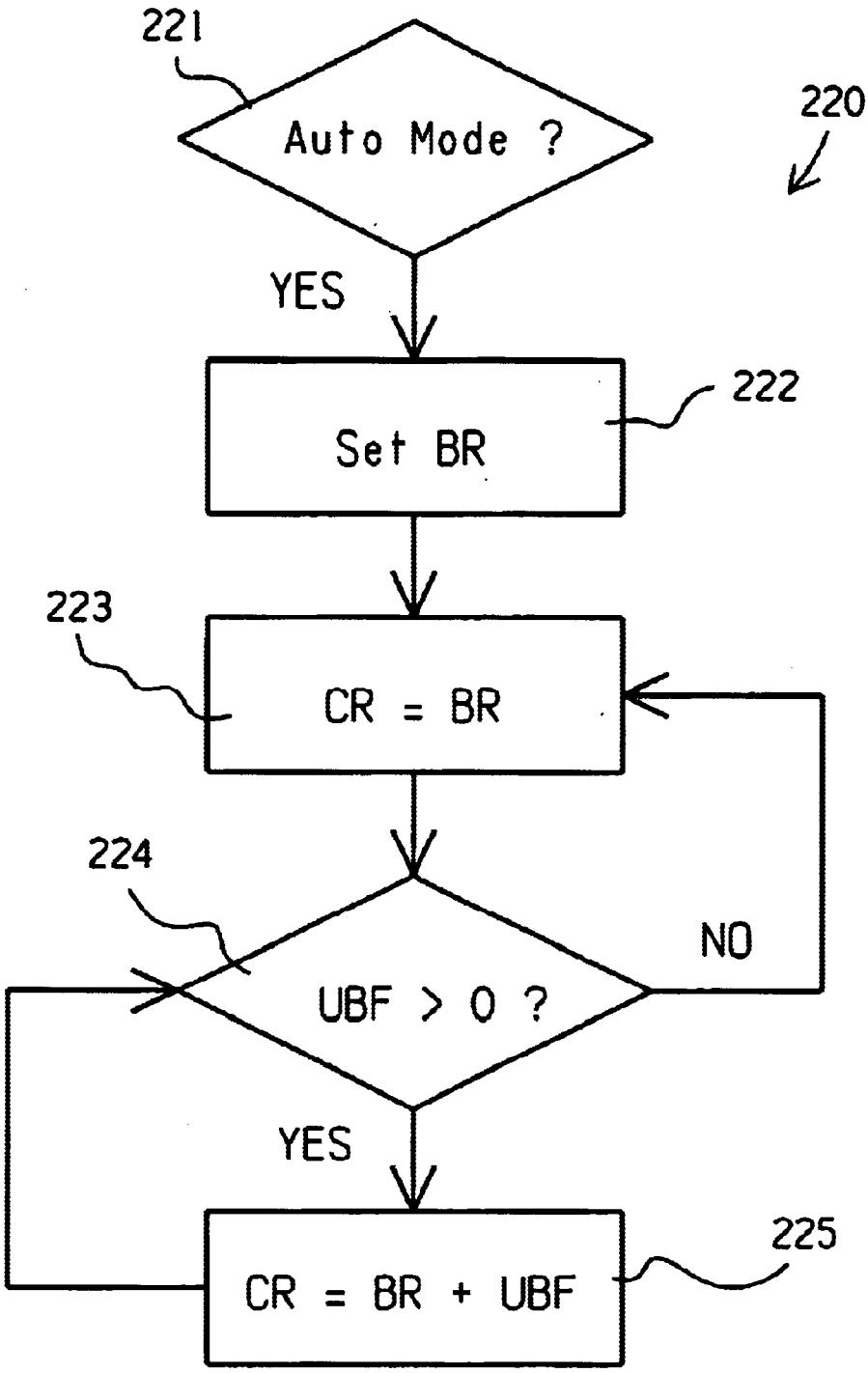
FIG. 4*a* is a flow chart of a control program suitable for use in conjunction with the exercise apparatus of FIG. 1.

Movement of a handlebar 170 relative to a respective rocker link 160 places strain on a respective strip 178. The magnitude of the strain (and/or the displacement experienced by the strip 178) may be used to assess the amount of work performed via the user's upper body and/or the relative amounts of work performed via the user's upper body and the user's lower body. This information may be displayed in various forms to the user and/or used in connection with various functions of the apparatus 100. For example, FIG. 4*a* shows a flow chart of a program 220 suitable for controlling the resistance device 126 during variable operation of the handlebars 170. The program 220 is described as "Auto Mode" because it is designed to automatically adjust the resistance device 126 as a function of force applied against the handlebars 170.

As an initial step 221, the program 220 activates in response to a signal to enter the Auto Mode. The next step 222 is to set the base resistance (BR) for resisting exercise of the lower body only. For example, the base resistance may be set manually by the user or based upon steady state operation of the apparatus 100 over the course of a particular time period. The next step 223 is to set the current resistance (CR) for the resistance device 126 to equal the base resistance (BR). The next step 224 is to process incoming data, if any, from the sensors 188. If no upper body force (UBF) is detected, then the program 220 returns to the step 223 of setting the current resistance. (CR) equal to the base resistance (BR). On the other hand, if upper body force (UBF) is detected, then the next step 225 is to increase the current resistance (CR) to provide a reactionary force to the upper body force (UBF). The program 220 then repeats the data processing step 224, which may involve taking multiple samples and/or performing mathematical analysis on the incoming data.

Figure 4B:
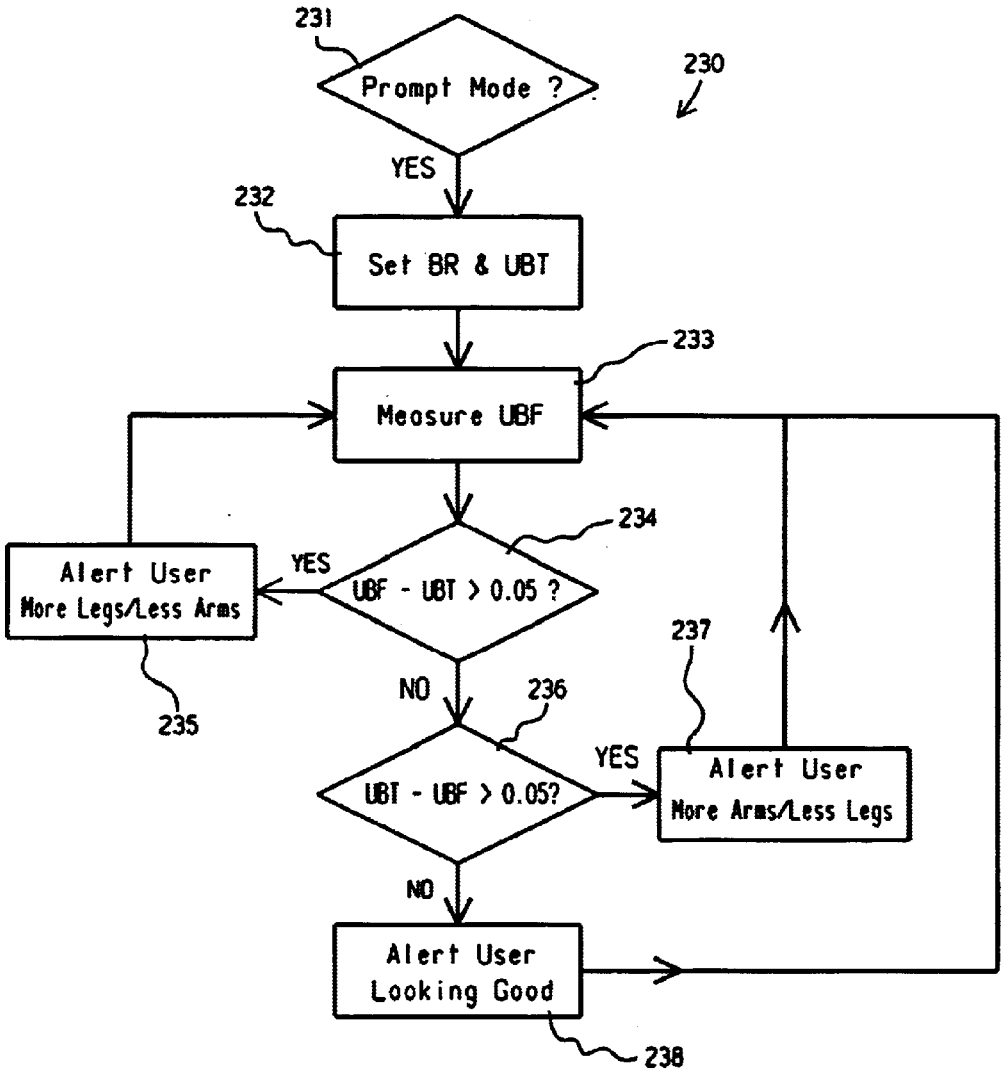
FIG. 4*b* is a flow chart of another control program suitable for use in conjunction with the exercise apparatus of FIG. 1.

FIG. 4*b* shows a flow chart of a program 230 suitable for signalling the user during variable operation of the handlebars 170. The program 230 is described as "Prompt Mode" because it is designed to prompt the user to distribute work between the upper body and lower body in accordance with a predetermined target distribution.

As an initial step 231, the program 230 activates in response to a signal to enter the Prompt Mode. The next step 232 is to set the base resistance (BR) and the upper body target (UBT) as a percentage of the base resistance. For example, the base resistance may be set manually by the user or based upon a heart rate portion of the control program, and the upper body target may be set manually by the user and/or established by another portion of the control program. The next steps 233–238 involve gathering and processing of data from the sensors 188. If step 234 determines that upper body force (UBF) exceeds the upper body target (UBT) by more than 5%, then the next step 235 signals the user to use more legs and/or less arms, and then the sampling step 233 is repeated. Otherwise, step 236 determines whether or not the detected upper body target (UBT) exceeds the upper body force (UBF) by more than 5%. If yes, then step 237 signals the user to use more arms and/or less legs, and then the sampling step 233 is repeated. If no, then step 238 signals the user that the actual distribution of work is comparable to the target distribution of work, and then the sampling step 233 is repeated. The program may be further refined to distinguish between the user's left and right arms and/or the user's left and right legs, and/or to compare total actual exertion to a total target level of exertion.

A user interface 190 is mounted on top of the forward stanchion. The programs 220 and 230 are stored within a memory chip in the interface 190, and both the strain gauges 188 and the eddy current resistance device 126 are placed in communication with a controller in the user interface 190 (via wires or other suitable means). The user interface 190 may be configured to perform a variety of functions, including displaying information to the user, such as (a) available exercise parameters and/or programs, (b) the current parameters and/or currently selected program (see windows 197 and 198), (c) the current time, (d) the elapsed exercise time (see window 194), (e) the current and/or average speed of exercise (see window 195), (f) the amount of work performed during exercise, (g) the simulated distance traveled during the current workout session and/or over the course of multiple workout sessions (see window 196), (h) material transmitted over the internet, and/or (i) discrete amounts of work being performed by the user's arms and/or legs. With respect to information based upon multiple workout sessions, the interface 190 may be programmed to store such data and also, to distinguish between multiple users of the apparatus 100. With regard to the distribution of work, bar graphs 191*a* and 191*b* show the relative amounts of work currently being performed by a user's upper body and lower body, respectively; bar graphs 192*a* and 192*b* show the relative amounts of work performed over the course of a workout by a user's upper body and lower body, respectively; and bar graphs 193*a* and 193*b* show the relative amounts of work performed over the course of multiple workouts by a user's upper body and lower body, respectively.

The user interface 190 may also be configured to perform functions allowing the user to (a) select or change the information being viewed, (b) select or change an exercise program, (c) adjust the resistance to exercise of the arms and/or the legs, (d) adjust the stroke length of the arms and/or the legs (if available), (e) adjust the orientation of the exercise motion (if available), and/or (f) quickly stop the exercise motion of the arms and/or the legs (if available). To facilitate the selection of such options, the user interface 190 includes user operable buttons 199 which may be pushed at various times and/or in various combinations to achieve a desired result.

Those skilled in the art will recognize that various functions of the apparatus 100 may be controlled by and/or performed in response to various types of signals, including (a) the user pushing a button 199 on the user interface 190 or on either handle 177; (b) a sensor detecting the presence or absence of the user's hands on the handles 177; (c) a sensor detecting the user's level of exertion (user exerted force and/or heart rate, for example) for comparison to a target level or range; (d) an automated program; and/or (e) a person other than the user (such as a trainer) who is in communication with the apparatus (via remote control and/or the internet, for example).

Figure 5:
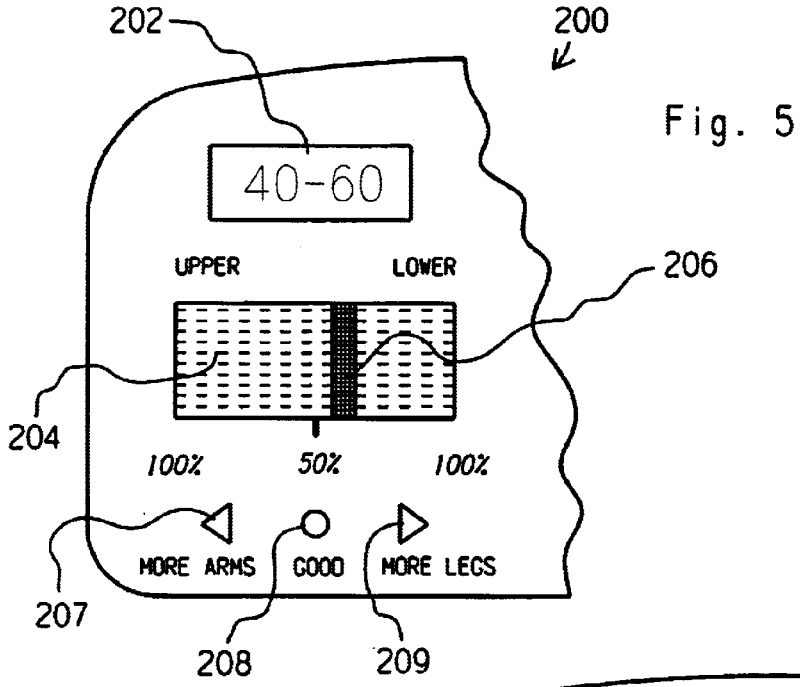
FIG. 5 is a plan view of an alternative user interface display.

Those skilled in the art will also recognize that other types of input devices and/or displays may be used without departing from the scope of the present invention. For example, FIG. 5 shows an alternative user interface 200 with two alternative displays of the relative amounts of work performed by a user's upper body and lower body. A first, digital display 202 shows the percentage of work performed by the user's upper body adjacent to the percentage of work performed by the user's lower body. A second, analog display includes a scale 204 and an indicator 206 which moves along the scale 204 to indicate the percentage of work being performed by the portion of the user's body that is currently performing the majority of the work. The user interface 200 also includes three LED displays 207–209 which may be alternatively lit to indicate the relationship between the user's current distribution of work and the user's target distribution of work. More specifically, the illumination of display 207 signals the user to increase the emphasis on upper body exercise; the illumination of display 208 signals the user to maintain the current distribution of work between upper body and lower body; and the illumination of display 209 signals the user to increase the emphasis on lower body exercise. Those skilled in the art will recognize that audible signals may used together with or in place of visible signals.

Figure 6:
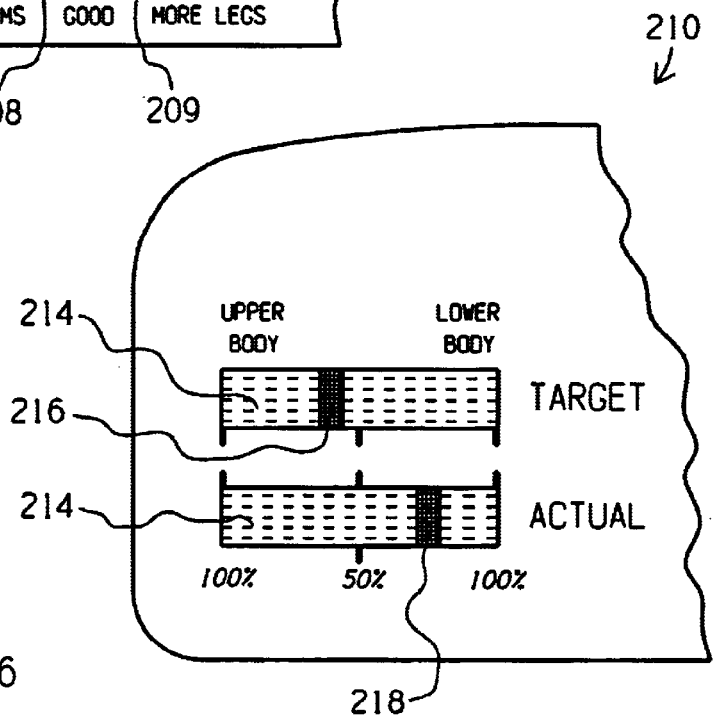
FIG. 6 is a plan view of another alternative user interface display.

Another alternative user interface 210 is shown in FIG. 6. Two analog displays are aligned relative to one another to facilitate a visual comparison between the target distribution of work and the actual distribution of work. Each display includes an identical scale 214 and a respective indicator 216 or 218. The indicator 216 moves along the upper scale 214 to indicate the user's target distribution of work between upper body and lower body, and the indicator 218 moves along the lower scale 214 to indicate the user's actual distribution of work between upper body and lower body. All of the foregoing displays may be enhanced to distinguish between the left and right sides of the person's body, as well.

Figure 7:
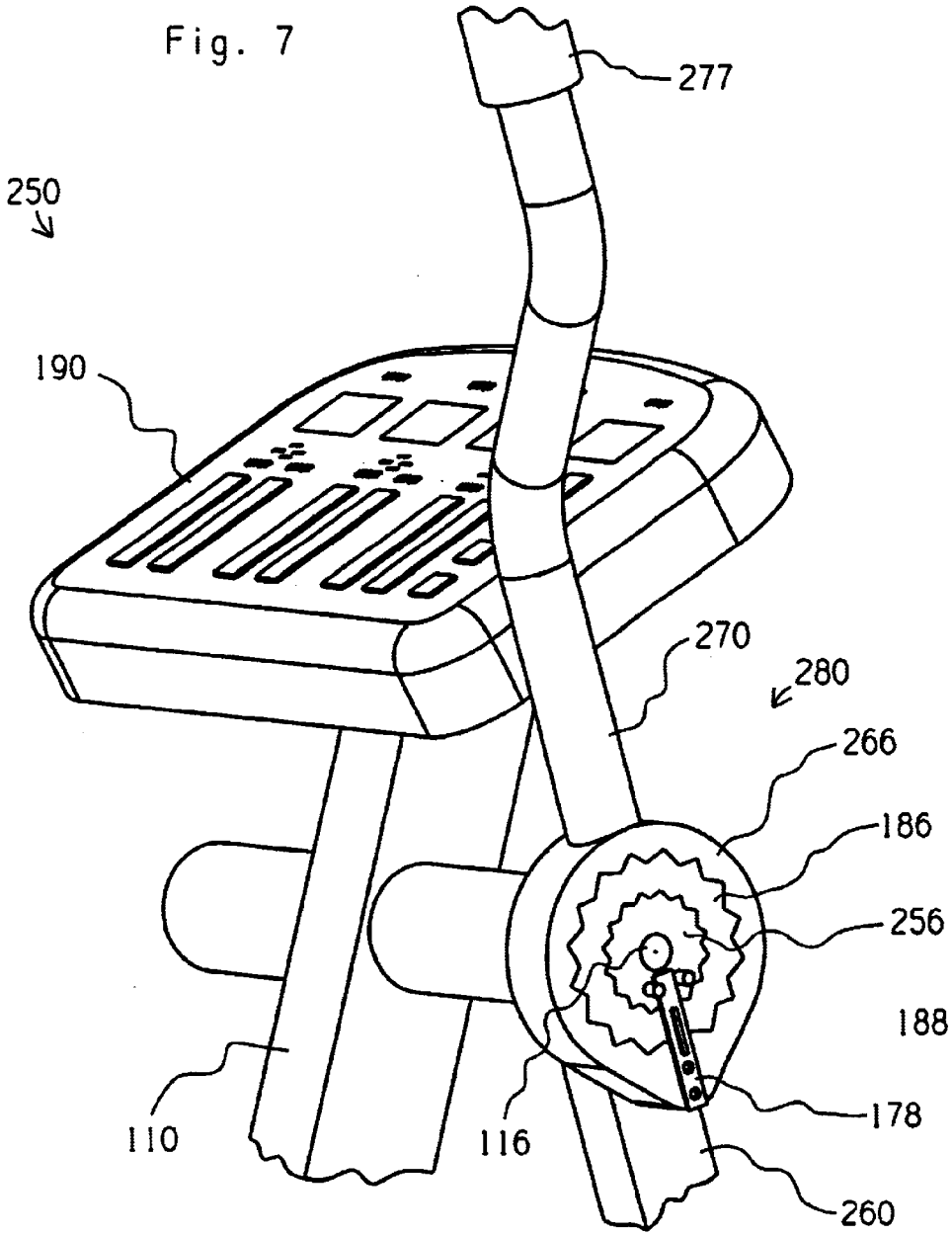
FIG. 7 is a perspective view of another exercise apparatus constructed according to the principles of the present invention.

The present invention may be implemented in various ways and/or to achieve various results. For example, another embodiment of the present invention is shown in FIG. 7. As suggested by the common reference numerals, the apparatus 250 is similar to the first embodiment 100, except for the rocker link 260, the handlebar 270, and the manner in which they are connected to one another and the frame 110 at connection assembly 280. In particular, a steel hub 256 is rotatably mounted on shaft 116, and a resilient member 186 is mounted on and about the hub 256, and a steel plate 266 is mounted on and about the resilient member 186. In other words, the resilient member 186 is interconnected between the hub 256 and the plate 266. Both the rocker link 260 and the handlebar 270 are rigidly secured to the plate 266. In response to the application of user force against the handle 277, the resilient member 186 accommodates movement of the handle 277 from its otherwise synchronized path of motion, and the strip 178 experiences strain as a function of such force.

Another, related embodiment may be implemented by switching each connection assembly 280 with a respective pivot joint 156 defined between the rocker link 260 and the foot supporting link 150. Yet another approach is to form the handlebars and respective rocker links as unitary pieces and place suitable sensors on the handle portions 277 of the handlebars or between the handlebars and movable handgrips on the handlebars.

Figure 8:
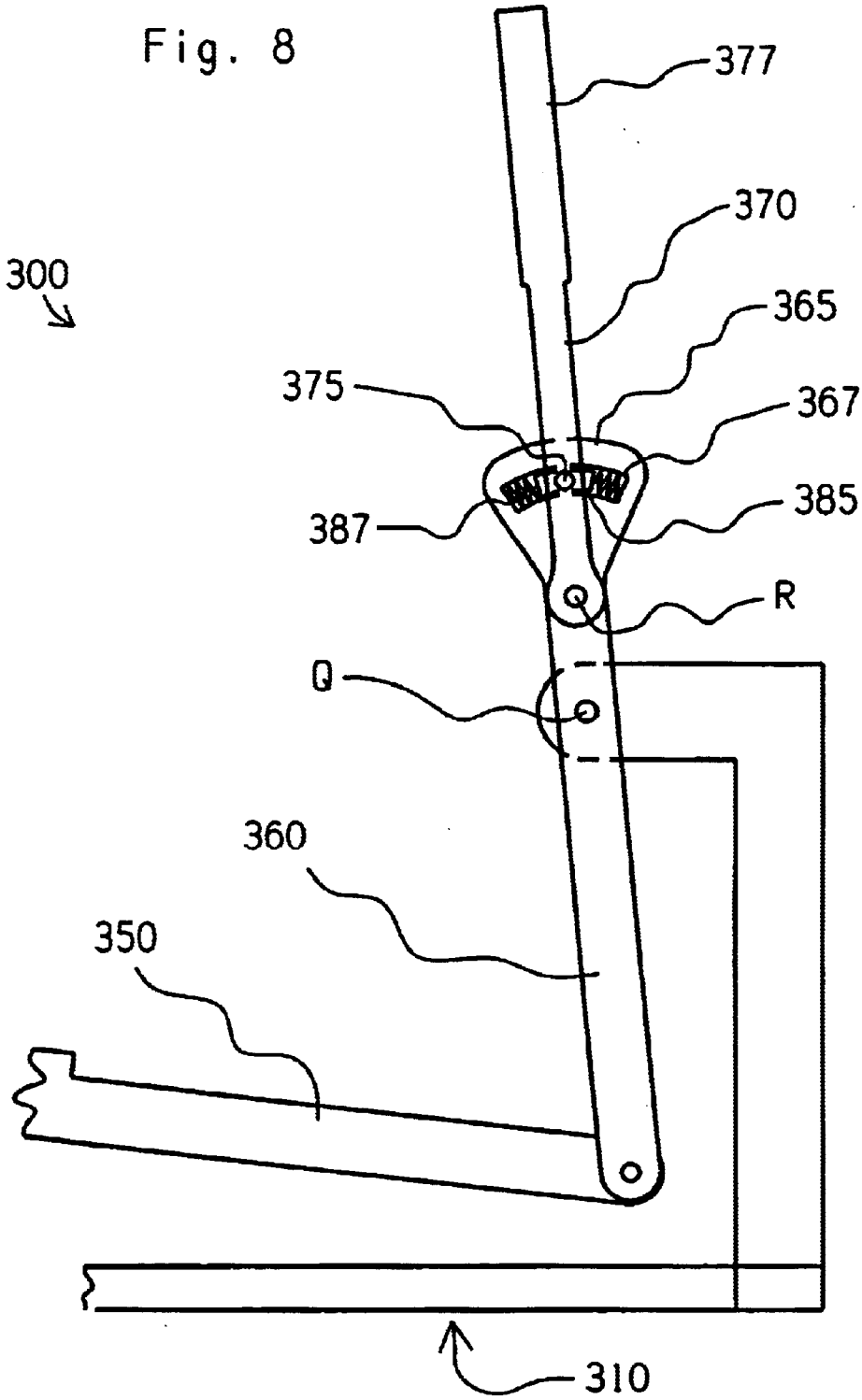
FIG. 8 is a side view of yet another exercise apparatus constructed according to the principles of the present invention.

Still another embodiment of the present invention is designated as 300 in FIG. 8. The exercise apparatus 300 includes a frame 310 designed to rest upon a floor surface, and a leg exercise assembly similar to that on the first embodiment 100. Among other things, the leg exercise assembly includes left and right foot supporting links 350 having forward ends rotatably connected to lower ends of respective rocker links 360. An intermediate portion of each foot supporting link is sized and configured to support a person's foot, and is constrained to move through a generally elliptical path.

An intermediate portion of each rocker link 360 is rotatably connected to the frame 310 at pivot axis Q. Left and right handlebars 370 have respective lower ends rotatably connected to respective rocker links 360 at respective pivot axes R (disposed a distance above the pivot axis Q). An opposite, upper end 377 of each handlebar 370 is sized and configured for grasping by a person standing on the foot supporting links 350.

An upper end 365 of each rocker link 360 is configured to provide an arcuate slot 367 which is centered about a respective pivot axis R. A respective block 385 is movably mounted within each slot 367, and is rigidly secured to an intermediate portion of a respective handlebar 370 (by means of a bolt 375, for example). First and second resilient members 387 are preferably disposed in respective gaps defined between opposite sides of the block 385 and opposite ends of the slot 367 to bias the handlebar 370 toward an aligned orientation relative to the rocker link 360. On this embodiment 300, the resilient members 387 are helical coil springs.

In the absence of user force applied against the handlebars 370, the handlebars 370 pivot in synchronized fashion together with respective rocker links 360. However, the resilient members 387 allow the handlebars 370 to be forcibly moved relative to respective rocker links 360 at the discretion (and strength) of the user. The embodiment 300 is shown without strain gauges or other sensors to emphasize that the "flexible synchronization" aspect of the present invention and the "responsive resistance" aspect of the present invention and the "display of work distribution" aspect of the present invention may used independent of each other. Additional examples include replacing the resilient member 186 on the embodiment 250 with a similarly sized and shaped rigid member, and/or replacing the strip 178 on the embodiment 100 with a sufficiently strong bar rigidly secured to both the plate 176 and the hub 166.

The present invention may also be described in functional terms along the following lines. For example, on an exercise apparatus comprising a frame designed to rest upon a floor surface; an arm supporting member; and a leg supporting member, wherein at least one of the supporting members is movably mounted on the frame, the present invention may be described in terms of (a) means for interconnecting the leg supporting member and the arm supporting member in such a manner that the path traversed by the user's hand is synchronized relative to the path traversed by the user's foot, until a threshold amount of user force is applied against the arm supporting member, in which case, the hand path may deviate from its otherwise synchronized path relative to the foot path; and/or (b) means for connecting the leg supporting member and the arm supporting member in such a manner that the path traversed by the user's hand is synchronized relative to the path traversed by the user's foot and movable against a resistance force which is measured and/or applied independent of the leg supporting member; and/or (c) means for displaying the distribution of work between a user's upper body and lower body.

The present invention also may be said to provide various methods which may be implemented in various ways and/or described with reference to various embodiments, including the foregoing embodiments. One such method is to provide arm and leg supporting members which are both synchronized and subject to independent resistance. Another such method is to provide arm and leg supporting members which are both encouraged to remain synchronized and selectively movable relative to one another. Yet another method is to move a person's hands and feet through respective paths which are synchronized relative to one another, while allowing deviation from the synchronized path in response to user applied force and/or providing separate resistance to movement along the respective paths. Yet another method is to measure and/or display work performed separately by a person's upper body and lower body.

The foregoing embodiments and associated methods are representative but not exhaustive examples of the subject invention. It is to be understood that the embodiments and/or their respective features may be mixed and matched in a variety of ways to arrive at other embodiments. For example, the control and/or display options described with reference to a particular embodiment are applicable to other embodiments, as well. Recognizing that this disclosure will lead those skilled in the art to recognize additional embodiments, modifications, and/or applications which fall within the scope of the present invention, the scope of the present invention is to be limited only to the extent of the claims which follow.

What is claimed is:

1. An exercise apparatus, comprising:

a frame designed to rest upon a floor surface;

a leg supporting member;

an arm supporting member, wherein at least one of the arm supporting member and the leg supporting member is pivotally mounted on the frame;

a resilient member interconnected between the arm supporting member and the leg supporting member to bias the arm supporting member toward a particular position relative to the leg supporting member, wherein user force may be applied against the arm supporting member to move the arm supporting member out of the particular position relative to the leg supporting member; and a sensor is connected to the arm supporting member to measure user force applied against the arm supporting member a resistance device connected to the leg supporting member and in communication with the sensor, wherein the resistance device is operable to provide adjustable resistance as a function of user force applied against the arm supporting member.

2. The exercise apparatus of claim 1, wherein the sensor is a strain gauge interconnected between the arm supporting member and the leg supporting member.

3. The exercise apparatus of claim 1, wherein the resilient member is a torsional spring keyed to both the arm supporting member and the leg supporting member.

4. The exercise apparatus of claim 3, wherein the torsional spring is made of rubber.

5. The exercise apparatus of claim 3, wherein both the leg supporting member and the arm supporting member are pivotally mounted on the frame at a common pivot axis.

6. The exercise apparatus of claim 1, wherein the resilient member is a linear spring interconnected between overlapping portions of the arm supporting member and the leg supporting member.

7. The exercise apparatus of claim 6, wherein the linear spring is a helical coil.

8. The exercise apparatus of claim 1, wherein the arm supporting member may be pushed in a first direction away from the particular position, and the arm supporting member may be pulled in an opposite, second direction away from the particular position.

9. The exercise apparatus of claim 1, further comprising a display mounted on the frame and in communication with the sensor, wherein the display includes a visual indication of user force applied against the arm supporting member.

10. The exercise apparatus of claim 9, wherein the display includes a visual indication of relative work performed by the user's upper body and the user's lower body.

11. The exercise apparatus of claim 1, wherein the leg supporting member is pivotally mounted on the frame.

12. The exercise apparatus of claim 11, wherein the arm supporting member is pivotally mounted on the frame.

13. The exercise apparatus of claim 1, further comprising a crank rotatably mounted on the frame and linked to the leg supporting member.

14. The exercise apparatus of claim 13, wherein a foot supporting link is movably interconnected between the crank and the leg supporting member.

15. The exercise apparatus of claim 14, wherein the leg supporting member is pivotally connected to the frame.

16. An exercise apparatus, comprising:

a frame designed to rest upon a floor surface;

a leg supporting member;

an arm supporting member, wherein the arm supporting member is connected to the leg supporting member, and at least one of the arm supporting, member and the leg supporting member is pivotally mounted on the frame and thereby defines a pivot axis;

an adjustable resistance device connected to the leg supporting member to provide resistance to movement of both the arm supporting member and the leg supporting member; and a means for adjusting the resistance to movement of the leg supporting member as a function of user force applied against the arm supporting member.

17. The exercise apparatus of claim 16, wherein both the arm supporting member and the leg supporting member are pivotally mounted on the frame at the pivot axis.

18. The exercise apparatus of claim 16, wherein a resilient member is interconnected between the arm supporting member and the leg supporting member.

* * * * *